US011994004B2

(12) United States Patent
Gharesi et al.

(10) Patent No.: US 11,994,004 B2
(45) Date of Patent: May 28, 2024

(54) BALL SEAT RELEASE APPARATUS

(71) Applicant: Halliburton Energy Services, Inc., Houston, TX (US)

(72) Inventors: Abdolreza Gharesi, Southlake, TX (US); Alan Tancel Jackson, Frisco, TX (US); Richard Paul Noffke, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/087,092

(22) Filed: Dec. 22, 2022

(65) Prior Publication Data

US 2023/0118264 A1 Apr. 20, 2023

Related U.S. Application Data

(63) Continuation of application No. 17/089,885, filed on Nov. 5, 2020, now Pat. No. 11,542,782.

(60) Provisional application No. 62/930,810, filed on Nov. 5, 2019.

(51) Int. Cl.
*E21B 34/14* (2006.01)

(52) U.S. Cl.
CPC ..... *E21B 34/142* (2020.05)

(58) Field of Classification Search
CPC ..... E21B 34/142; E21B 34/14; E21B 23/01
See application file for complete search history.

(56) References Cited

U.S. PATENT DOCUMENTS

| | | | | |
|---|---|---|---|---|
| 3,189,095 | A | 6/1965 | De Rochemont | |
| 4,554,981 | A | 11/1985 | Davies | |
| 4,603,743 | A | 8/1986 | Lindsey, Jr. | |
| 4,893,678 | A | 1/1990 | Stokley et al. | |
| 5,029,642 | A | 7/1991 | Crawford | |
| 5,695,009 | A | 12/1997 | Hipp | |
| 6,481,496 | B1 | 11/2002 | Jackson et al. | |
| 10,018,015 | B2 * | 7/2018 | Purkis | E21B 47/002 |
| 10,246,971 | B2 * | 4/2019 | Doane | E21B 34/103 |
| 10,487,625 | B2 * | 11/2019 | Jacob | E21B 23/00 |
| 10,927,644 | B2 * | 2/2021 | Atilano | E21B 43/14 |
| 2002/0092654 | A1 | 7/2002 | Coronado et al. | |
| 2002/0144814 | A1 | 10/2002 | Allamon et al. | |
| 2004/0094304 | A1 | 5/2004 | Turner et al. | |

(Continued)

FOREIGN PATENT DOCUMENTS

| | | | |
|---|---|---|---|
| CN | 202031565 | U | 11/2011 |
| CN | 202500543 | U | 10/2012 |

(Continued)

*Primary Examiner* — Shane Bomar
(74) *Attorney, Agent, or Firm* — Scott Richardson; Parker Justiss, P.C.

(57) ABSTRACT

Provided, in one aspect, is a ball seat release apparatus. The ball seat release apparatus, according to this embodiment, includes a shear sleeve, and a ball seat body located at least partially within the shear sleeve, a shear feature releasably coupling the ball seat body to the shear sleeve. The ball seat release apparatus according to this aspect further includes a ball seat slidingly engaged within the ball seat body, the ball seat configured to move from a first linear position to a second linear position, and further wherein a locking dog releasably couples the ball seat with the ball seat body.

12 Claims, 7 Drawing Sheets

(56) References Cited

U.S. PATENT DOCUMENTS

| | | | |
|---|---|---|---|
| 2010/0132954 | A1 | 6/2010 | Telfer |
| 2012/0067583 | A1 | 3/2012 | Zimmerman et al. |
| 2013/0256035 | A1 | 10/2013 | Radford et al. |
| 2015/0218904 | A1 | 8/2015 | Chauffe et al. |
| 2017/0175487 | A1 | 6/2017 | Marcin et al. |
| 2017/0234107 | A1 | 8/2017 | Atilano et al. |
| 2017/0342800 | A1 | 11/2017 | Themig |
| 2018/0051538 | A1 | 2/2018 | Zhang et al. |
| 2018/0148993 | A1 | 5/2018 | Schmidt et al. |
| 2021/0332661 | A1 | 10/2021 | Tonti et al. |
| 2022/0195843 | A1 | 6/2022 | Gharesi et al. |
| 2023/0055946 | A1* | 2/2023 | Macin Moreno ... E21B 33/0422 |

FOREIGN PATENT DOCUMENTS

| | | | |
|---|---|---|---|
| CN | 103573213 | A | 2/2014 |
| CN | 103628853 | A | 3/2014 |
| CN | 203655228 | U | 6/2014 |
| CN | 104632169 | A | 5/2015 |
| CN | 107100606 | A | 8/2017 |
| CN | 108999591 | A | 12/2018 |
| CN | 109477365 | A | 3/2019 |
| CN | 105625971 | B | 5/2019 |
| EP | 2020482 | B1 | 9/2012 |
| WO | 2019073200 | A1 | 4/2019 |
| WO | 2019122004 | A2 | 6/2019 |

* cited by examiner

BALL SEAT RELEASE APPARATUS

CROSS-REFERENCE TO RELATED APPLICATION

This application is a continuation of U.S. application Ser. No. 17/089,885, filed on Nov. 5, 2020, entitled "BALL SEAT RELEASE APPARATUS," which claims the benefit of U.S. Provisional Application Ser. No. 62/930,810, filed on Nov. 5, 2019, entitled "BALL SEAT RELEASE ASSEMBLY," and is commonly assigned with this application and incorporated herein by reference in their entirety.

BACKGROUND

In conventional practice, the drilling of an oil or gas well involves creating a wellbore that traverses numerous subterranean formations. For a variety reasons, each of the formations through which the well passes is preferably sealed. For example, it is important to avoid an undesirable passage of formation fluids, gases or materials from the formations into the wellbore or for wellbore fluids to enter the formations. In addition, it is commonly desired to isolate producing formations from one another and from nonproducing formations.

Accordingly, conventional well architecture often includes the installation of casing within the wellbore. In addition to providing the sealing function, the casing also provides wellbore stability to counteract the geomechanics of the formation such as compaction forces, seismic forces and tectonic forces, thereby preventing the collapse of the wellbore wall. The casing is generally fixed within the wellbore by a cement layer that fills the annulus between the outer surface of the casing and the wall of the wellbore. For example, once a casing string is located in its desired position in the well, a cement slurry is pumped via the interior of the casing, around the lower end of the casing and upward into the annulus. After the annulus around the casing is sufficiently filled with the cement slurry, the cement slurry is allowed to harden, thereby supporting the casing and forming a substantially impermeable barrier.

In standard practice, the wellbore is drilled in intervals with casing installed in each interval before the next interval is drilled. As such, each succeeding casing string placed in the wellbore typically has an outside diameter having a reduced size when compared to the previously installed casing string. Specifically, a casing to be installed in a lower wellbore interval must be passed through the previously installed casing strings in the upper wellbore intervals. In one approach, each casing string extends downhole from the surface such that only a lower section of each casing string is adjacent to the wellbore wall. Alternatively, the wellbore casing strings may include one or more liner strings, which do not extend to the surface of the wellbore, but instead typically extend from near the bottom end of a previously installed casing string downward into the uncased portion of the wellbore. In such installations, the liner string may be set or suspended from a liner hanger positioned between the downhole end of the previously installed casing string and an uphole end of the liner string.

BRIEF DESCRIPTION

Reference is now made to the following descriptions taken in conjunction with the accompanying drawings, in which.

DETAILED DESCRIPTION

Downhole equipment is often installed/activated using hydraulic pressure. The pressure is generated by closing the internal diameter ("ID") of the string and pumping the close volume until the activation pressure for the downhole equipment is achieved. For liner hanger installation, a setting ball is typically used to close the running tool ID and pressure is applied inside the drill string to set the hanger and release the running tool.

In some application, there is a requirement to re-establish the circulation after the liner hanger is set, particularly when expandable liner hangers are used. This requires removing and/or bypassing the ball. A typical hydraulically activated tool will require high pressure to release the ball to open the tubing ID. This pressure can cause a pressure shock to the formation when it is released below the running tool, possibly damaging the formation. A liner hanger designed, manufactured and operated according to the disclosure employs a soft ball seat release apparatus, which allows for re-establishing the flow path without exceeding the normal circulation pressure.

Figure 1:
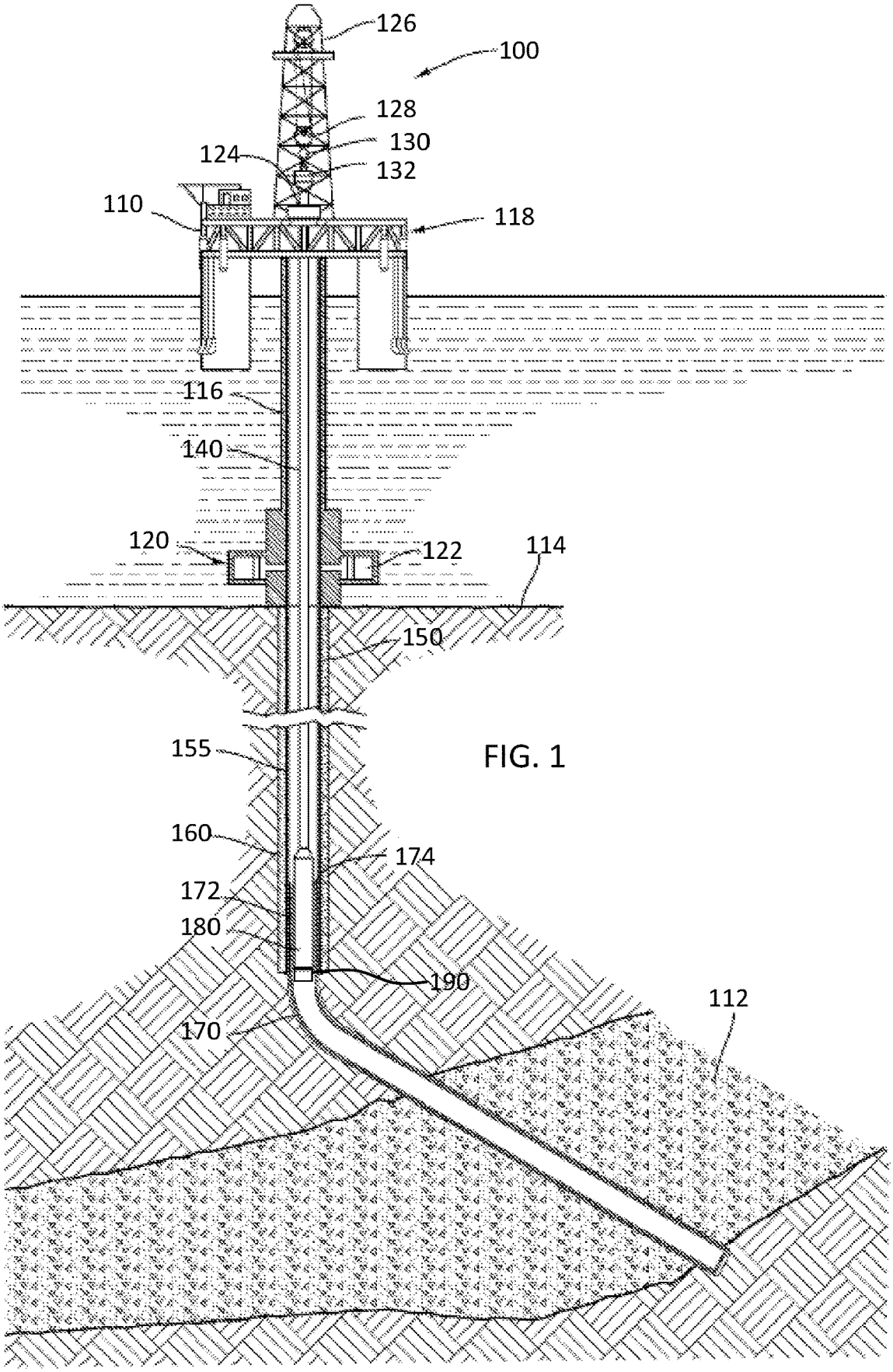
FIG. 1 illustrates a well system designed, manufactured and operated according to the disclosure.

Referring initially to FIG. 1, illustrated is a well system 100 designed, manufactured and operated according to the disclosure. The well system 100, in one embodiment, employs a ball seat release apparatus (e.g., soft release) 190 also designed, manufactured and operated according to the disclosure. In the well system 100, a semi-submersible platform 110 is centered over a submerged oil and gas formation 112 located below sea floor 114. A subsea conduit 116 extends from deck 118 of platform 110 to wellhead installation 120, including blowout preventers 122. Platform 110 has a hoisting apparatus 124, a derrick 126, a travel block 128, a hook 130 and a swivel 132 for raising and lowering a downhole conveyance 140, including without limitation pipe strings, a work string, etc.

A wellbore 150 has been drilled in sections through the various earth strata, including formation 112. A casing string 155 is secured within an upper portion of wellbore 150 by cement 160. The term "casing" is used herein to designate a tubular string operable to be positioned in a wellbore, for example to provide wellbore stability. The casing may be of the type known to those skilled in the art as a "liner" and may be made of any material, such as steel or a composite material. The casing may be a jointed tubular string or a continuous tubular string. Extending downhole from casing string 155 into a lower portion of wellbore 150 is a liner string 170 that includes at its upper end, a liner hanger 172 and a liner top 174.

The ball seat release apparatus (e.g., soft release) 190, in the illustrated embodiment, is coupled to the downhole conveyance 140 and running tool 180. In accordance with the disclosure, the ball seat release apparatus 190 allows for re-establishing the flow path below the running tool 180, for example without removing the running tool 180 from the wellbore 150, and also without exceeding the normal circulation pressure. Accordingly, the flow path may be re-established without a pressure shock to the formation.

Even though FIG. 1 depicts a liner string 170 being installed in a slanted wellbore, it should be understood by those skilled in the art that the present system is equally well suited for use in wellbores having other orientations including vertical wellbores, horizontal wellbores, deviated wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the present system is equally well suited for use in onshore operations.

Figure 2:
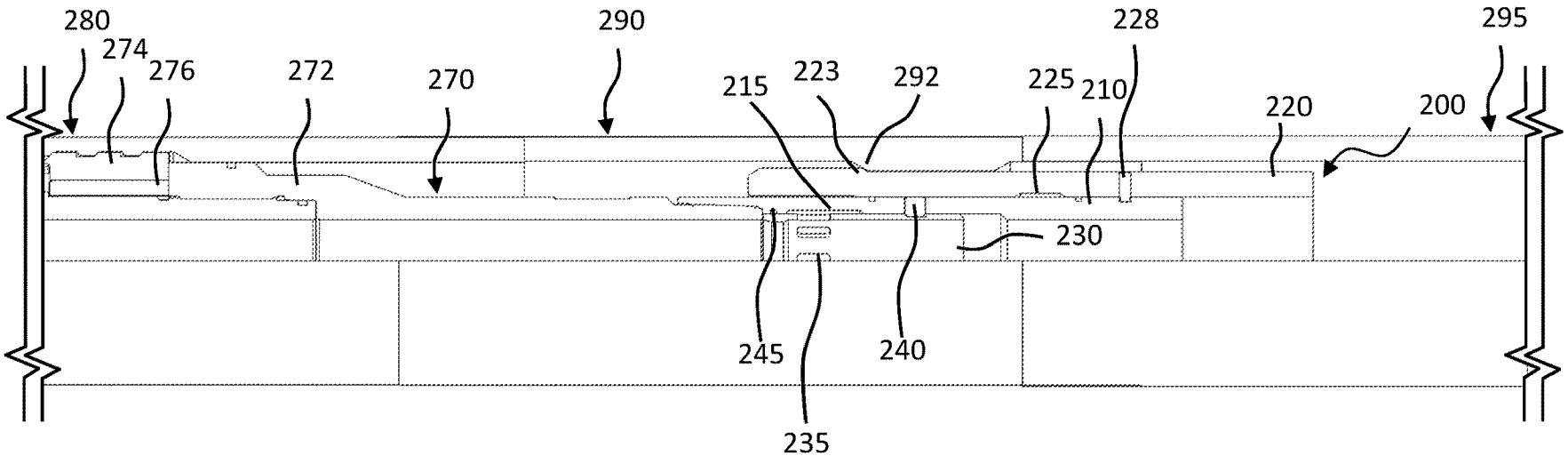
FIG. 2 illustrates a ball seat release apparatus designed, manufactured and operated according to the disclosure.

Turning to FIG. 2, illustrated is a partial cutaway view of a ball seat release apparatus 200 designed, manufactured and operated according to the disclosure. The ball seat release apparatus 200, in the illustrated embodiment, has been run downhole on a running tool 270. In the illustrated embodiment, the ball seat release apparatus 200 and running tool 270 are positioned within a liner hanger 280, a crossover sub 290, and a liner string 290. Those skilled in the art appreciate that an opposite end of the liner hanger 280 would be coupled to a casing string, such that the liner hanger 280 anchors and seals the liner string 295 from the casing string.

The running tool 270, in the illustrated embodiment, includes a tool string 272 that extends uphole toward a surface of the wellbore. The running tool 270, in the illustrated embodiment, additionally includes a collet 274, as well as a collet support 276. The collet 274, as illustrated, may have a collet profile that engages a related profile in a bottom end of the liner hanger 280. Thus, as the running tool 270 is moved downhole, and the collet profile of the collet 274 engages the profile in the liner hanger 280, the collet 274 will remain fixed while the liner hanger 280 is set with the casing string.

The ball seat release apparatus 200, in the illustrated embodiment of FIG. 2, includes a ball seat body 210. The ball seat body 210, in one embodiment, is a ball seat mandrel body. The ball seat body 210, in the illustrated embodiment, includes a recess pocket 215 formed along at least a portion of an inner surface thereof. The ball seat body 210, in the embodiment of FIG. 2, is at least partially located within a shear sleeve 220. The shear sleeve 220, in the illustrated embodiment, includes a shoulder 223 that is engageable with a shoulder 292 in the crossover sub 290. The shear sleeve 220 additionally includes a recess pocket 225 positioned along at least a portion of an interior surface thereof. Further to the embodiment of FIG. 2, a shear feature 228 releasably couples the shear sleeve 220 to the ball seat body 210. The shear feature 228, in one embodiment, is a shear pin.

The ball seat release apparatus 200, in the embodiment of FIG. 2, additionally includes a ball seat 230 slidingly engaged within the ball seat body 210. The ball seat 230, as those skilled in the art appreciate, is configured to engage (e.g., seat) with a drop ball or plug deployed within the running tool 270. The ball seat 230, in one embodiment, includes one or more fluid bypass slots 235. Furthermore, the ball seat 230 is positioned proximate the recess pocket 215 in the ball seat body 210 in the embodiment shown.

In the embodiment of FIG. 2, a locking dog 240 releasably couples the ball seat 230 with the ball seat body 210. The locking dog 240, in one embodiment, is a radially expanding feature. For example, the locking dog 240 may be a radially expanding collet in one embodiment. Further to the embodiment of FIG. 2, a seal 245 (e.g., O-ring in one embodiment) is positioned between the ball seat body 210 and the ball seat 230.

Figure 3:
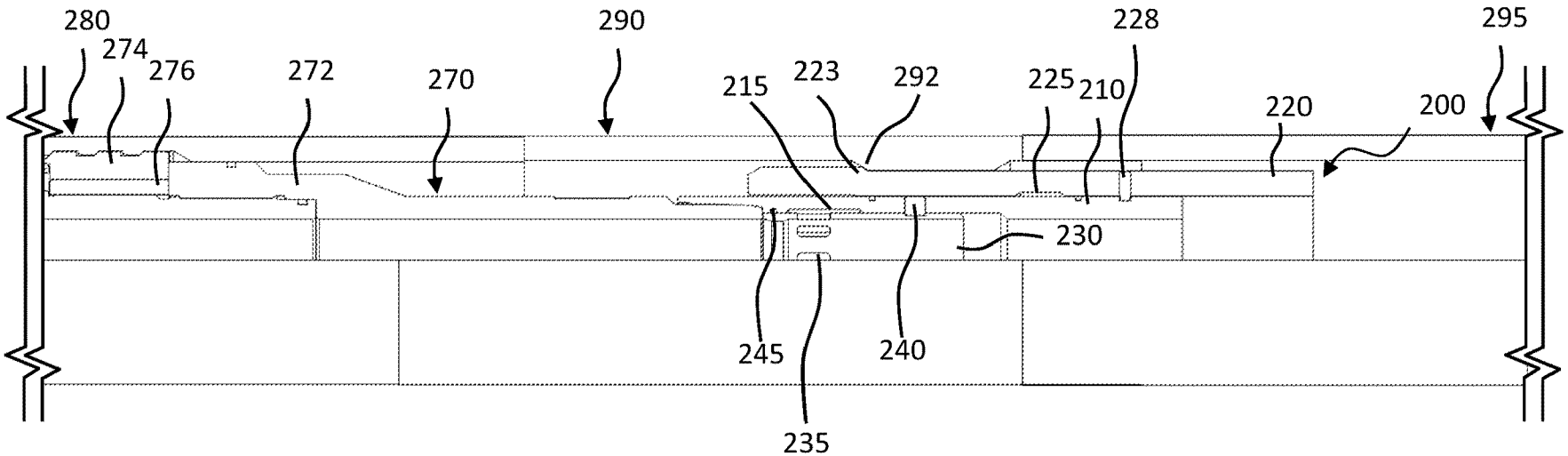
FIGS. 3-7 illustrate various different operational states of the ball seat release apparatus illustrated in FIG. 2.

Turning now to FIGS. 3-7, illustrated are various different partial cutaway views of the ball seat release apparatus 200 at different operational states within the liner hanger 280, crossover sub 290 and liner string 295. The ball seat release apparatus 200 is illustrated in FIG. 3 in its run-in-hole operational state. Accordingly, the ball seat release apparatus 200 is coupled to the running tool 270. Moreover, the shear pin 228 is fixing the shear sleeve 220 to the ball seat body 210. Accordingly, the locking dog 240 is held in its radially retracted state by an inner surface of the shear sleeve 220. Moreover, the ball seat 230 is held in a first linear position by the locking dog 240. The first linear position, in the embodiment of FIG. 3, is an uphole linear position.

Figure 4:
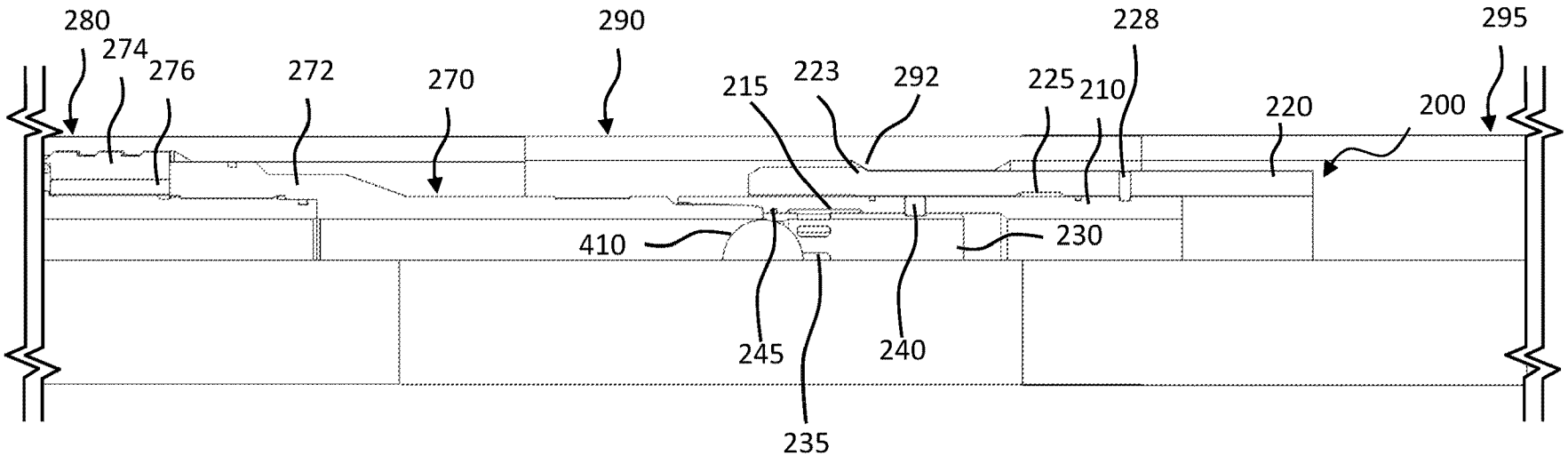

Turning to FIG. 4, illustrated is the ball seat release apparatus of FIG. 3 after deploying a drop ball or plug 410 with the running tool 270. The drop ball or plug 410, in the illustrated embodiment, seats with the ball seat 230. With the drop ball or plug 410 seated with the ball seat 230, the running tool 270 and ball seat release apparatus 200 may be subjected to one or more pressure cycles. The pressure cycles, in this embodiment, set the liner hanger 280, for example by driving a cone that radially expands the liner hanger 280 in engagement with the uphole casing string. At this stage, the liner hanger 280 fixes the liner string 295 with the casing string.

Figure 5:
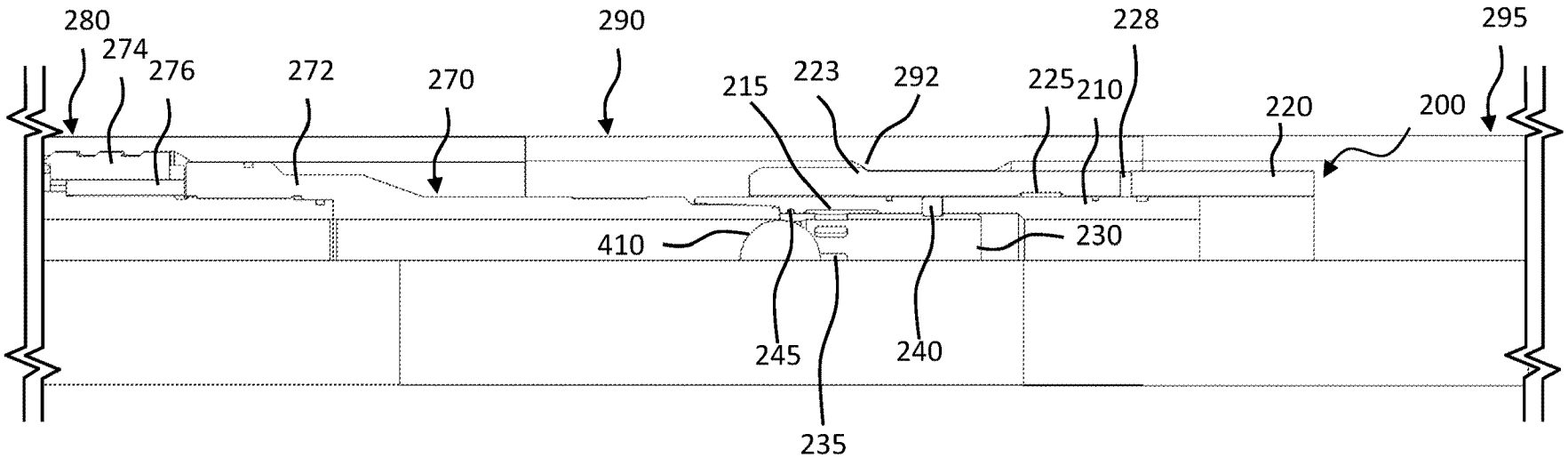

Turning to FIG. 5, illustrated is the ball seat release apparatus of FIG. 4 after setting weight down on the ball seat release apparatus 200 via the running tool 270. As shown, the running tool pushes the entire ball seat release apparatus 200 downhole until the shoulder 223 on the shear sleeve 220 engages the shoulder 292 on the liner string 290. Thereafter, the shear sleeve 220 moves no further, but the ball seat body 210 and the ball seat 230 continue to move downhole, thereby shearing the shear pin 228. At this stage, the ball seat body 210 and the ball seat 230 are able to move relative to the shear sleeve 220.

Figure 6:
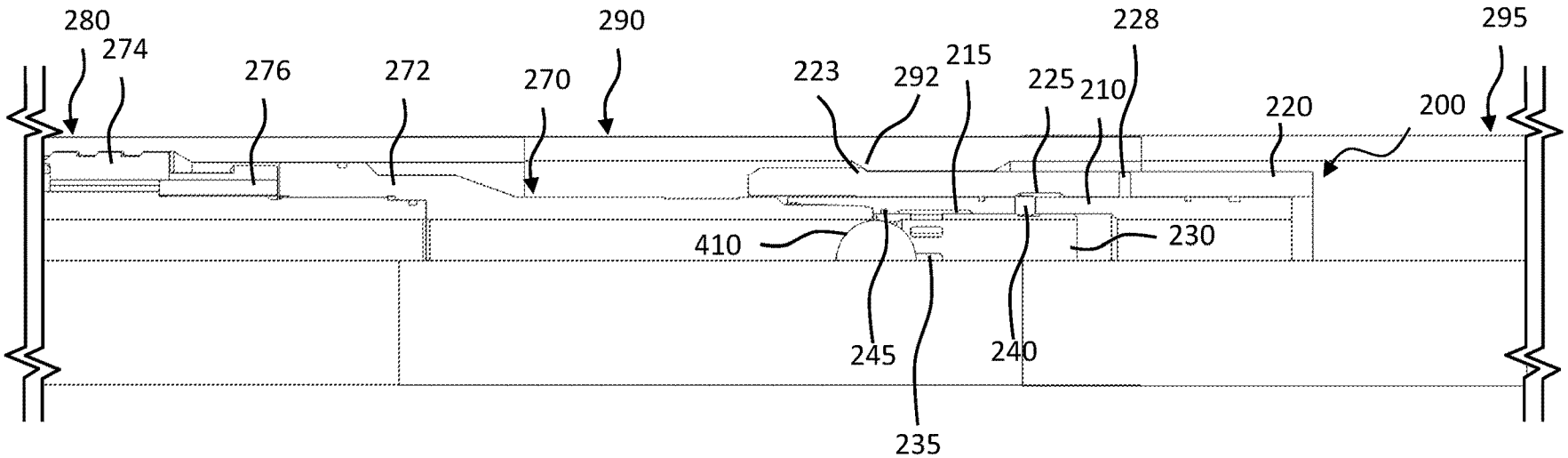

Turning to FIG. 6, illustrated is the ball seat release apparatus 200 of FIG. 5, after the ball seat body 210 and ball seat 230 continue to move downhole. As illustrated, the locking dog 240 may then align with the recess pocket 225, thereby allowing the locking dog 240 to radially extend into the recess pocket 225. With the locking dog 240 in the recess pocket 225, the ball seat 230 is free to move linearly relative to the ball seat body 210.

Figure 7:
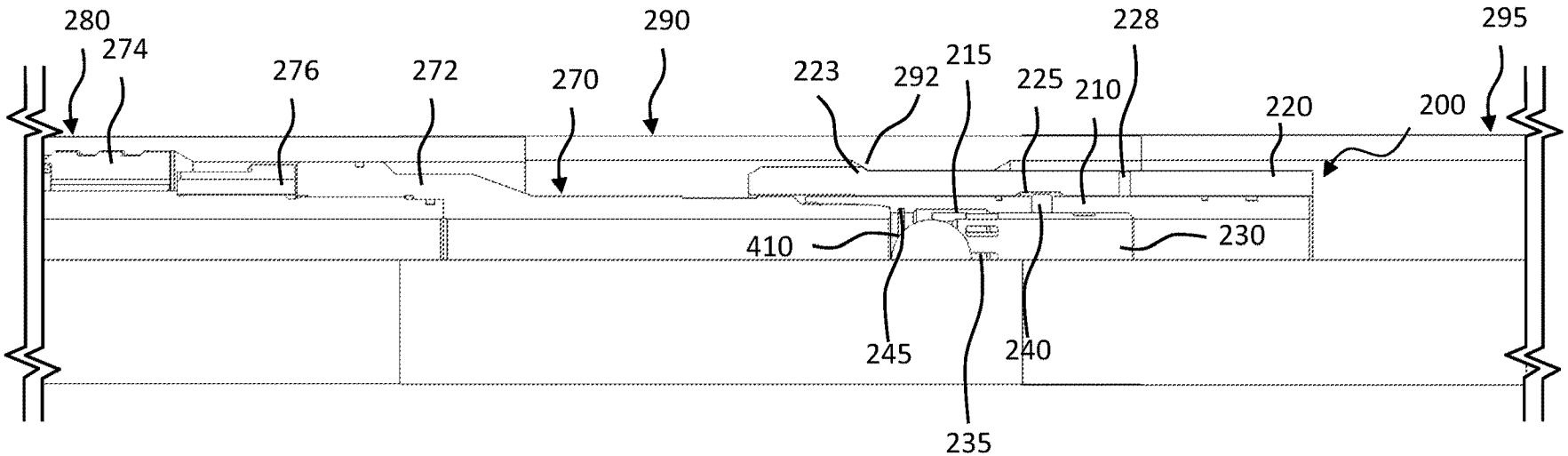

Turning to FIG. 7, illustrated is the ball seat release apparatus 200 of FIG. 6, after fluid (e.g., low pressure fluid) is pumped down the running tool 270 thereby sliding the ball seat 230 to a second linear position. The second linear position, in the illustrated embodiment, is a downhole linear position. With the ball seat 230 in the second linear position, the fluid may bypass the ball by sliding over the ball 410, into the recess pocket 215 in the ball seat body 210 and through the fluid bypass slot 235. In this embodiment, the drop ball or plug 410 remains seated against the ball seat 230, and thus the full ID of the tool is not accessible for fluid flow. Nevertheless, the flow path is re-established without a pressure shock to the formation.

In an alternative embodiment, the ball seat 230 is a radially expanding collet. Accordingly, as the ball seat 230 moves to the second linear position, the ball seat 230 radially expands, thereby releasing the drop ball or plug 410 downhole. Thus, in contrast to providing a fluid path around the drop ball or plug 410, as described above, the drop ball or plug 410 is released to re-establish the flow path. According to this embodiment, the full ID of the tool is accessible for fluid flow, and furthermore the fluid bypass ports 235 in the ball seat 230 are not necessary.

Aspects disclosed herein include:

A. A ball seat release apparatus, the ball seat release apparatus including: 1) a shear sleeve; 2) a ball seat body located at least partially within the shear sleeve, a shear feature releasably coupling the ball seat body to the shear sleeve; and 3) a ball seat slidingly engaged within the ball seat body, the ball seat configured to move from a first linear position to a second linear position, and further wherein a locking dog releasably couples the ball seat with the ball seat body.

B. A well system, the well system including: 1) a casing string secured within a wellbore extending through one or more subterranean formations; 2) a liner hanger and liner string suspended from and proximate a downhole end of the casing string; and 3) a ball seat release apparatus coupled proximate a downhole end of a running tool, and positioned within at least a portion of the liner hanger or liner string, the ball seat release apparatus including; a) a shear sleeve; b) a ball seat body located at least partially within the shear sleeve, a shear feature releasably coupling the ball seat body to the shear sleeve; and c) a ball seat slidingly engaged within the ball seat body, the ball seat configured to move from a first linear position to a second linear position, and further wherein a locking dog releasably couples the ball seat with the ball seat body.

C. A method for completing a well system, the method including: 1) deploying a liner hanger and liner string within a casing string using a running tool, wherein a ball seat release apparatus is coupled proximate a downhole end of the running tool, the ball seat release apparatus including a) a shear sleeve; b) a ball seat body located at least partially within the shear sleeve, a shear feature releasably coupling the ball seat body to the shear sleeve; and c) a ball seat slidingly engaged within the ball seat body, the ball seat configured to move from a first linear position to a second linear position, and further wherein a locking dog releasably couples the ball seat with the ball seat body; 2) positioning the liner hanger proximate a downhole end of the casing string; 3) placing a drop ball or plug within the casing string, the drop ball or plug seating against the ball seat; and 4) pressuring up on the drop ball or plug seated against the ball seat to set the liner hanger and fix the liner string relative to the casing string, and then moving the running tool downhole to move the ball seat from the first linear position to the second linear position and provide a fluid path downhole of the ball seat release apparatus.

Aspects A, B, and C may have one or more of the following additional elements in combination: Element 1: wherein the shear sleeve has a first recess pocket positioned along a portion of an interior surface thereof, and further wherein the locking dog is configured to radially expand into the recess pocket to thereby allow the ball seat to move from the first linear position to the second linear position. Element 2: wherein the ball seat body has a second recess pocket positioned along a portion of an interior surface thereof. Element 3: wherein the second recess pocket is configured to provide a fluid flow path around a drop ball or plug when the ball seat moves to the second linear position. Element 4: wherein the ball seat includes one or more bypass slots therein. Element 5: wherein the second recess pocket and one or more bypass slots are configured to provide a fluid flow path around a drop ball or plug when the ball seat moves to the second linear position. Element 6: wherein the ball seat is a radially expandable collet, and further wherein the radially expandable collet is configured to expand and release a drop ball or plug when the ball seat moves to the second linear position. Element 7: wherein the shear sleeve has a first recess pocket positioned along a portion of an interior surface thereof, and further wherein the locking dog is configured to radially expand into the recess pocket to thereby allow the ball seat to move from the first linear position to the second linear position. Element 8: wherein the ball seat body has a second recess pocket positioned along a portion of an interior surface thereof. Element 9: wherein the second recess pocket is configured to provide a fluid flow path around a drop ball or plug when the ball seat moves to the second linear position. Element 10: wherein the ball seat includes one or more bypass slots therein. Element 11: wherein the second recess pocket and one or more bypass slots are configured to provide a fluid flow path around a drop ball or plug when the ball seat moves to the second linear position. Element 12: wherein the ball seat is a radially expandable collet, and further wherein the radially expandable collet is configured to expand and release a drop ball or plug when the ball seat moves to the second linear position. Element 13: wherein moving the running tool downhole to move the ball seat from the first linear position to the second linear position provides a fluid path around the drop ball or plug and downhole of the ball seat release apparatus. Element 14: wherein the shear sleeve has a first recess pocket positioned along a portion of an interior surface thereof, and further wherein the locking dog is configured to radially expand into the recess pocket to thereby allow the ball seat to move from the first linear position to the second linear position, and further wherein the ball seat body has a second recess pocket positioned along a portion of an interior surface thereof, the second recess pocket providing the fluid flow path around the drop ball or plug when the ball seat moves to the second linear position. Element 15: wherein moving the running tool downhole to move the ball seat from the first linear position to the second linear position allows the ball seat to radially expand to release the drop ball or plug and provide the fluid path downhole of the ball seat release apparatus. Element 16: wherein the ball seat is a radially expandable collet, and further wherein the radially expandable collet is configured to expand and release the drop ball or plug when the ball seat moves to the second linear position. Element 17: wherein moving the running tool downhole to move the ball seat from the first linear position to the second linear position first shears the shear pin, and then allows the locking dog to radially expand to release the ball seat from the ball seat body.

Those skilled in the art to which this application relates will appreciate that other and further additions, deletions, substitutions and modifications may be made to the described embodiments.

What is claimed is:

1. A ball seat release apparatus, comprising:

a shear sleeve;

a ball seat body located at least partially within the shear sleeve, a shear feature releasably coupling the ball seat body to the shear sleeve; and a non-radially expanding ball seat slidingly engaged within the ball seat body, the ball seat configured to move from a first linear position to a second linear position, and further wherein a locking dog releasably couples the ball seat with the ball seat body.

2. The ball seat release apparatus as recited in claim 1, wherein the shear sleeve has a first recess pocket positioned along a portion of an interior surface thereof, and further wherein the locking dog is configured to radially expand into the recess pocket to thereby allow the ball seat to move from the first linear position to the second linear position.

3. The ball seat release apparatus as recited in claim 2, wherein the ball seat body has a second recess pocket positioned along a portion of an interior surface thereof.

4. The ball seat release apparatus as recited in claim 3, wherein the second recess pocket is configured to provide a fluid flow path around a drop ball or plug when the ball seat moves to the second linear position.

5. The ball seat release apparatus as recited in claim 3, wherein the ball seat includes one or more bypass slots therein.

6. The ball seat release apparatus as recited in claim 5, wherein the second recess pocket and one or more bypass slots are configured to provide a fluid flow path around a drop ball or plug when the ball seat moves to the second linear position.

7. A well system, comprising:

a casing string secured within a wellbore extending through one or more subterranean formations;

a liner hanger and liner string suspended from and proximate a downhole end of the casing string; and a ball seat release apparatus coupled proximate a downhole end of a running tool, and positioned within at least a portion of the liner hanger or liner string, the ball seat release apparatus including:

a shear sleeve;

a ball seat body located at least partially within the shear sleeve, a shear feature releasably coupling the ball seat body to the shear sleeve; and a non-radially expanding ball seat slidingly engaged within the ball seat body, the ball seat configured to move from a first linear position to a second linear position, and further wherein a locking dog releasably couples the ball seat with the ball seat body.

8. The well system as recited in claim 7, wherein the shear sleeve has a first recess pocket positioned along a portion of an interior surface thereof, and further wherein the locking dog is configured to radially expand into the recess pocket to thereby allow the ball seat to move from the first linear position to the second linear position.

9. The well system as recited in claim 8, wherein the ball seat body has a second recess pocket positioned along a portion of an interior surface thereof.

10. The well system as recited in claim 9, wherein the second recess pocket is configured to provide a fluid flow path around a drop ball or plug when the ball seat moves to the second linear position.

11. The well system as recited in claim 9, wherein the ball seat includes one or more bypass slots therein.

12. The well system as recited in claim 11, wherein the second recess pocket and one or more bypass slots are configured to provide a fluid flow path around a drop ball or plug when the ball seat moves to the second linear position.

* * * * *